US008459054B1

(12) United States Patent
Reece

(10) Patent No.: US 8,459,054 B1
(45) Date of Patent: Jun. 11, 2013

(54) MULTI-STAGE DIRECT EVAPORATION COOLING SYSTEM AND METHOD

(76) Inventor: Melvin E. Reece, Tucson, AZ (US)

( * ) Notice: Subject to any disclaimer, the term of this patent is extended or adjusted under 35 U.S.C. 154(b) by 14 days.

(21) Appl. No.: 13/177,223

(22) Filed: Jul. 6, 2011

Related U.S. Application Data

(62) Division of application No. 12/534,751, filed on Aug. 3, 2009, now Pat. No. 7,992,406.

(51) Int. Cl.
*F28D 5/00* (2006.01)

(52) U.S. Cl.
USPC ..... 62/314; 62/259.4

(58) Field of Classification Search
USPC ..... 62/314, 315, 316, 457.9
See application file for complete search history.

(56) References Cited

U.S. PATENT DOCUMENTS

| | | | | |
|---|---|---|---|---|
| 3,996,314 | A | 12/1976 | Lakmaker | 261/30 |
| 4,047,571 | A | 9/1977 | Chaintrier et al. | 169/60 |
| 4,309,365 | A | 1/1982 | Van Ness et al. | 261/29 |
| 4,312,819 | A * | 1/1982 | Leyland | 261/152 |
| 4,376,082 | A | 3/1983 | Heck | 261/127 |
| 4,498,912 | A | 2/1985 | Wagner | 55/233 |
| 4,612,778 | A | 9/1986 | Medrano | 62/311 |
| 4,730,462 | A | 3/1988 | Rogers | 62/171 |
| 4,732,012 | A | 3/1988 | Thorpe | 62/304 |
| 4,768,350 | A | 9/1988 | Moran | 62/259.1 |
| 4,928,583 | A | 5/1990 | Taylor et al. | 98/31.6 |
| 4,983,102 | A | 1/1991 | Swain | 417/394 |
| 5,003,789 | A | 4/1991 | Gaona et al. | 62/304 |
| 5,005,373 | A | 4/1991 | East | 62/259.1 |
| 5,079,934 | A * | 1/1992 | Vinokurov | 62/304 |
| 5,425,674 | A | 6/1995 | Stach | 454/201 |
| 5,509,565 | A | 4/1996 | Hoffman | 220/378 |
| 5,720,407 | A | 2/1998 | Hoffman | 220/215 |
| 5,956,964 | A | 9/1999 | Wright | 62/304 |
| 6,101,831 | A * | 8/2000 | Ciccone | 62/310 |
| 6,161,362 | A | 12/2000 | Forbis, Sr. et al. | 52/745.06 |
| 6,223,548 | B1 | 5/2001 | Calvert | 62/304 |
| 6,502,414 | B1 | 1/2003 | Calvert | 62/304 |
| 6,546,745 | B2 | 4/2003 | Torres et al. | 62/259.1 |
| 6,895,772 | B2 * | 5/2005 | Johnson et al. | 62/314 |
| 7,322,205 | B2 * | 1/2008 | Bourne et al. | 62/305 |
| 7,395,676 | B2 * | 7/2008 | White | 62/310 |
| 2002/0155807 | A1 | 10/2002 | Moor et al. | 454/342 |

FOREIGN PATENT DOCUMENTS

EP 1 035 396 A2 9/2000

OTHER PUBLICATIONS

Roy Otterbein, "Two Stage Evaporative Cooling", Home Energy Magazine Online May/Jun. 1997 http://hem.dis.anl.gov/eehem/97/970511.html.

Leo Rainer, "Advanced Two-Stage Design Hits the Market", Home Energy Magazine Online May/Jun. 1997, http:///hem.dis.anl.gov/eehem/97/970512.html.

(Continued)

*Primary Examiner* — Melvin Jones
(74) *Attorney, Agent, or Firm* — Hayes Soloway P.C.

(57) ABSTRACT

A multi-stage evaporative cooling system and method employing direct evaporative cooling at each stage. An exhaust fan is located between stages to expel warm air and partially depressurize the vapor space. An aspect of the present disclosure also describes the application of evaporative cooling to a pet shelter.

19 Claims, 10 Drawing Sheets

OTHER PUBLICATIONS

Hercules Industries online catalog product "Mastercool 2 Stage Indirect Cooling Module" http://www.herculesindustries.com/products_catalog_Request2.asp?txtid=216 Jan. 20, 2004.

EnviroTherm online catalog product "Mastercool's Two-State Indirect Cooling Module" http://www.envirotherm.com/index.php?pg=coolingmastercool Jan. 20, 2004.

Jonas Heating Cooling online catalog product "MasterCool Two Stage Cooling System" http://www.jonasoil.com/mastercooltwostage.htm Jan. 20, 2004.

Adams Refrigeration Co. Since 1947 Mastercool Contractor 602-269-6447 File://C:\WINDOWS\TEMP_8SGVJEGQ.htm Jan. 20, 2004.

* cited by examiner

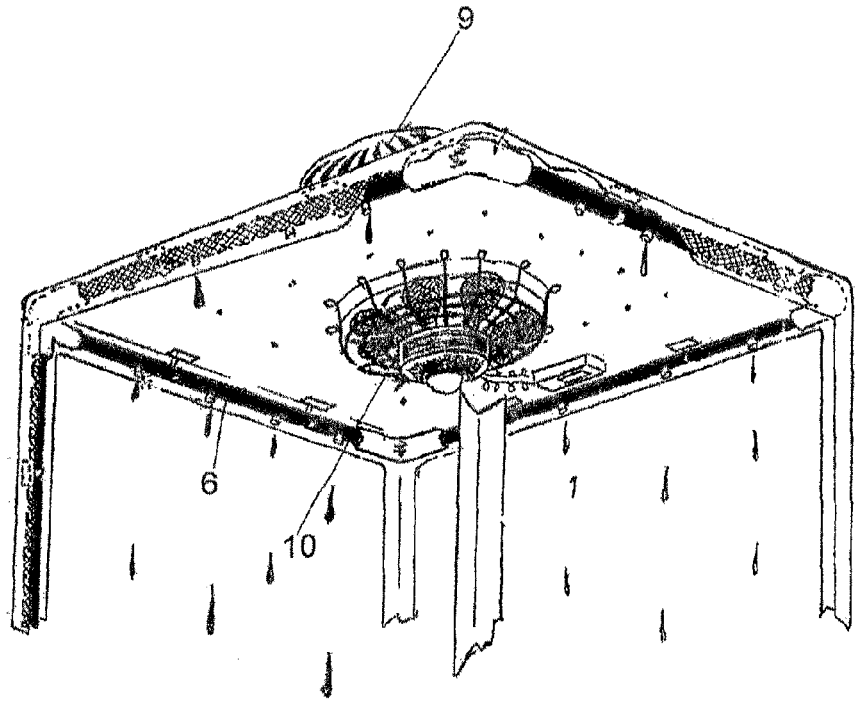
FIG. 3
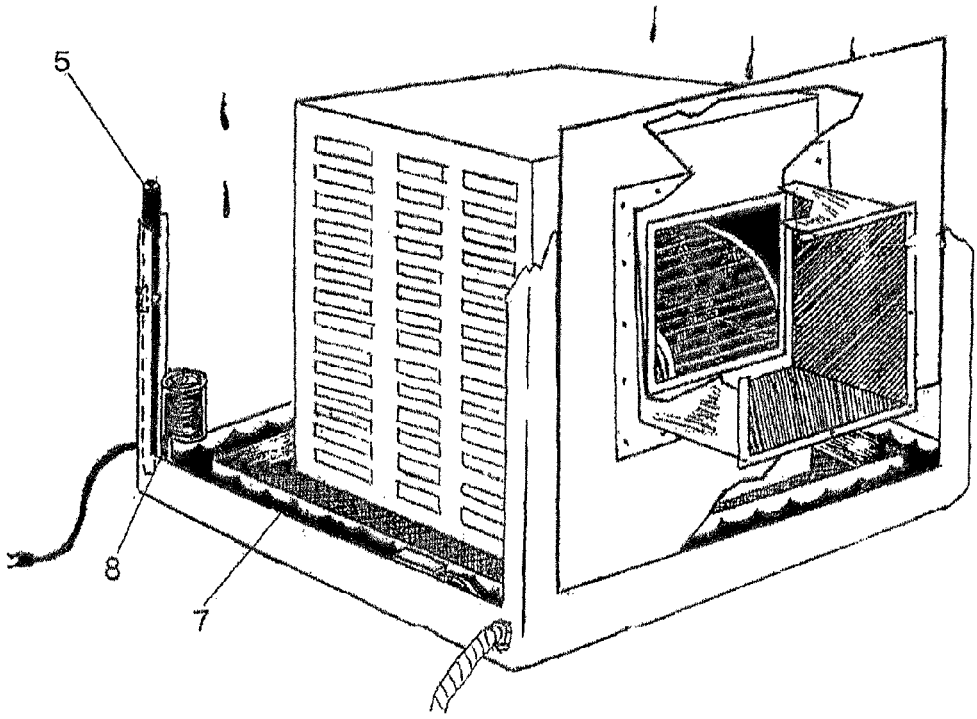

MULTI-STAGE DIRECT EVAPORATION COOLING SYSTEM AND METHOD

CROSS REFERENCE TO RELATED APPLICATION

This application is a divisional of U.S. application Ser. No. 12/534,751, filed Aug. 3, 2009, now U.S. Pat. No. 7,992,406, the contents of which are incorporated herein by reference.

FIELD OF THE INVENTION

The present disclosure relates to evaporative cooling systems and methods. In particular, this disclosure relates to insulated multi-stage evaporative cooling systems and methods.

BACKGROUND OF THE INVENTION

Evaporative coolers are relatively simple cooling devices that provide a substantial amount of relief in arid regions, such as the southwestern United States. Evaporative coolers pump relatively dry atmospheric air through water-soaked filter pads. The latent heat of evaporation is transferred to the water, transforming hot, dry air into cool, moist air.

Typical evaporative cooler designs are able to come within 10° F. of the wet-bulb temperature, which is the minimum temperature that may be achieved by evaporative cooling. Because evaporative cooling is less expensive than typical air conditioning methods, several attempts have been made to increase the efficiency of the device in order to more closely approximate the wet-bulb temperature.

Designs currently available attempt to increase the efficiency of evaporative cooling by adding insulating and reflecting panels to the frame of the apparatus. This keeps external effects on the system, such as heat from solar radiation, to a minimum.

Other available improvements include the addition of an indirect evaporative cooling stage. In effect, the indirect evaporative cooling stage uses water as the heat exchange medium in a heat exchanger to lower the temperature of the air without adding humidity. Then, when the cooler air is passed through the evaporative cooling system, the resulting temperature of the air is closer to the wet-bulb temperature.

These developments have yielded a modest increase in efficiency. But, due to growing concerns about the environment and the rising costs of energy consumption, there remains a substantial need for improved evaporative cooling systems and methods.

SUMMARY OF THE INVENTION

To address the problems described above, the present disclosure provides an improved evaporative cooling system and method utilizing multiple direct evaporation stages. A fan is used to partially evacuate the vapor space between the two stages. Other advantageous features are included in the summary of various aspects of the invention below.

A first aspect of the present disclosure provides an evaporative cooling system for providing cool air to a structure, comprised of a water source connected to an outer cooling unit and an inner cooling unit. Both the inner and outer cooling units include a shell and a plurality of removable panels. A vapor space is formed in between the outer cooling unit and the inner cooling unit. The outer cooling unit also includes at least one exhaust fan located in the top of the outer cooling unit. The outer cooling unit completely encloses the inner cooling unit, which may be a pre-existing evaporative cooling system. The roof of the outer cooling unit may be sloped to encourage the exhausting of hot air. Misting nozzles may be located in the vapor space to provide an additional source of cooling. A chemical monitoring device may also be included to avoid filling the structure with unwanted gasses.

Another aspect of the present disclosure provides a pet shelter having an evaporative cooling system. The pet shelter includes a water supply system connected to a water source, comprised of a plurality of lengths of water piping and nozzles, and a trough for collecting water at the base of the structure. An exhaust fan may be located in the top of the pet shelter. The walls of the shelter may be constructed of a material that allows some air to pass through. Further, one or more walls may be hinged to the top of the pet shelter and could be propped open using a stand.

Yet another aspect of the present disclosure provides a method for cooling a structure by evaporative cooling, comprising: directing air through a first evaporative cooling unit into a vapor space; partially evacuating the vapor space using at least one exhaust fan; passing the air through a second evaporative cooling unit; and delivering the air to the structure.

BRIEF DESCRIPTION OF THE DRAWINGS

Further features and advantages of the present disclosure will be seen from the following detailed description, taken in conjunction with the accompanying drawings, wherein:

FIG. 3 is an exploded view of a multi-stage evaporative cooling system in accordance with the present disclosure;

DETAILED DESCRIPTION OF PREFERRED EMBODIMENTS

In the following description, reference is made to the accompanying drawings, which form a part hereof, and in which is shown, by way of illustration, various embodiments of the present disclosure. It is understood that other embodiments may be utilized and changes may be made without departing from the scope of the present disclosure.

The present disclosure provides a system that facilitates multiple-stage evaporative cooling wherein each stage comprises direct evaporative cooling. By placing an exhaust fan or by using other dehumidification methods between the various stages of the system, the present disclosure is able to achieve a final air temperature that comes closer to achieving an output at the wet-bulb temperature than can be achieved by currently used evaporative cooling systems. Other features, as described herein, also contribute to improved performance.

Figure 1:
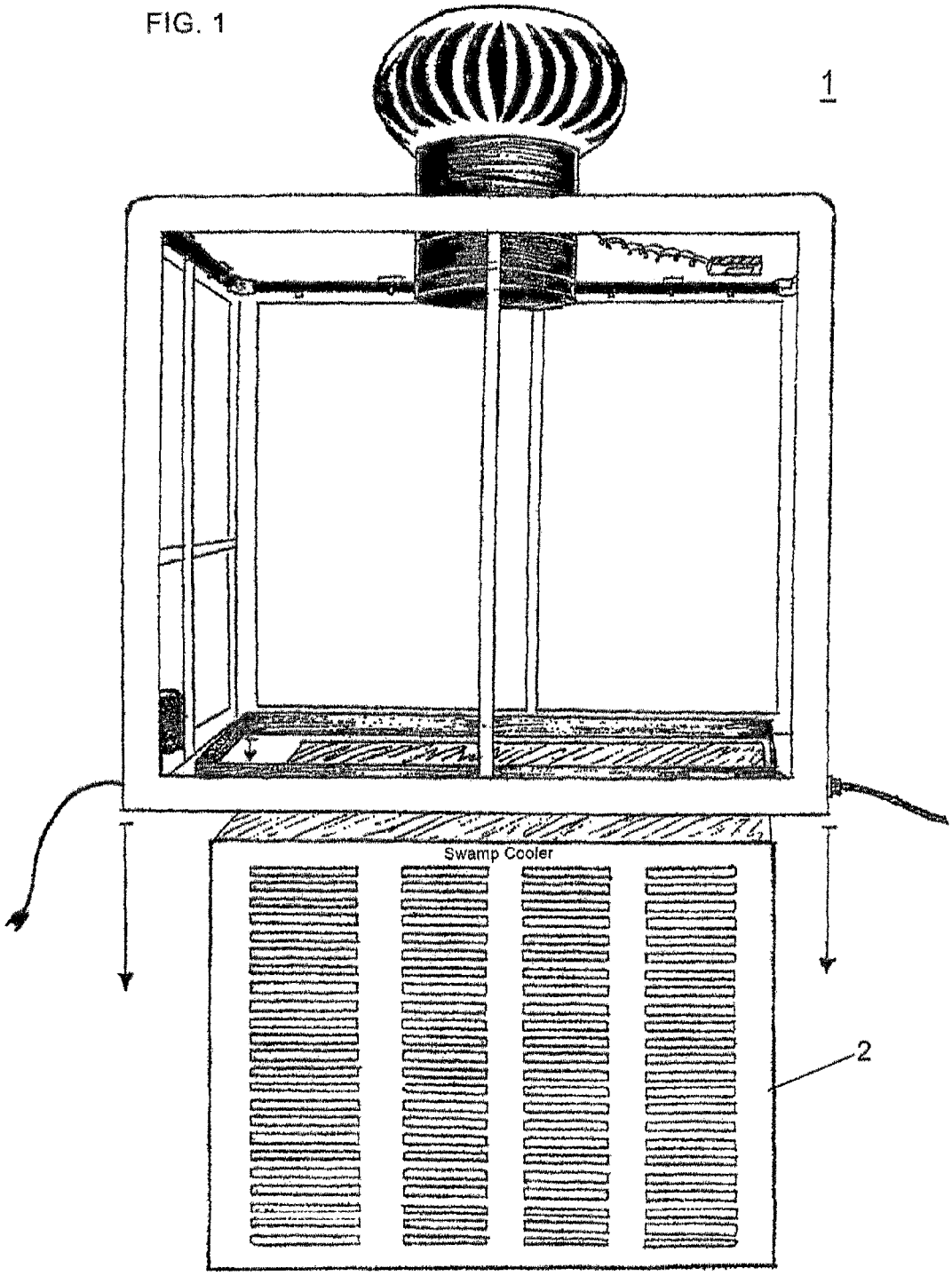
FIG. 1 is an exploded view illustrating an outer cooling unit of the present disclosure being placed over an existing evaporative cooler.

A first aspect of the present disclosure provides an improved evaporative cooling system wherein various features are provided to augment the process of an existing, single-stage evaporative cooler. Referring to FIG. 1, the improved evaporative cooling system includes an outer cooler 1 that surrounds the pre-existing evaporative cooler 2 on all sides. The outer cooler may be placed over the top of a pre-existing evaporative cooler, such as when the pre-existing cooler is located on a roof. Arrangements can also be made to install the outer cooler over a pre-existing system that is located on the side of a building (see FIG. 4).

Figure 2:
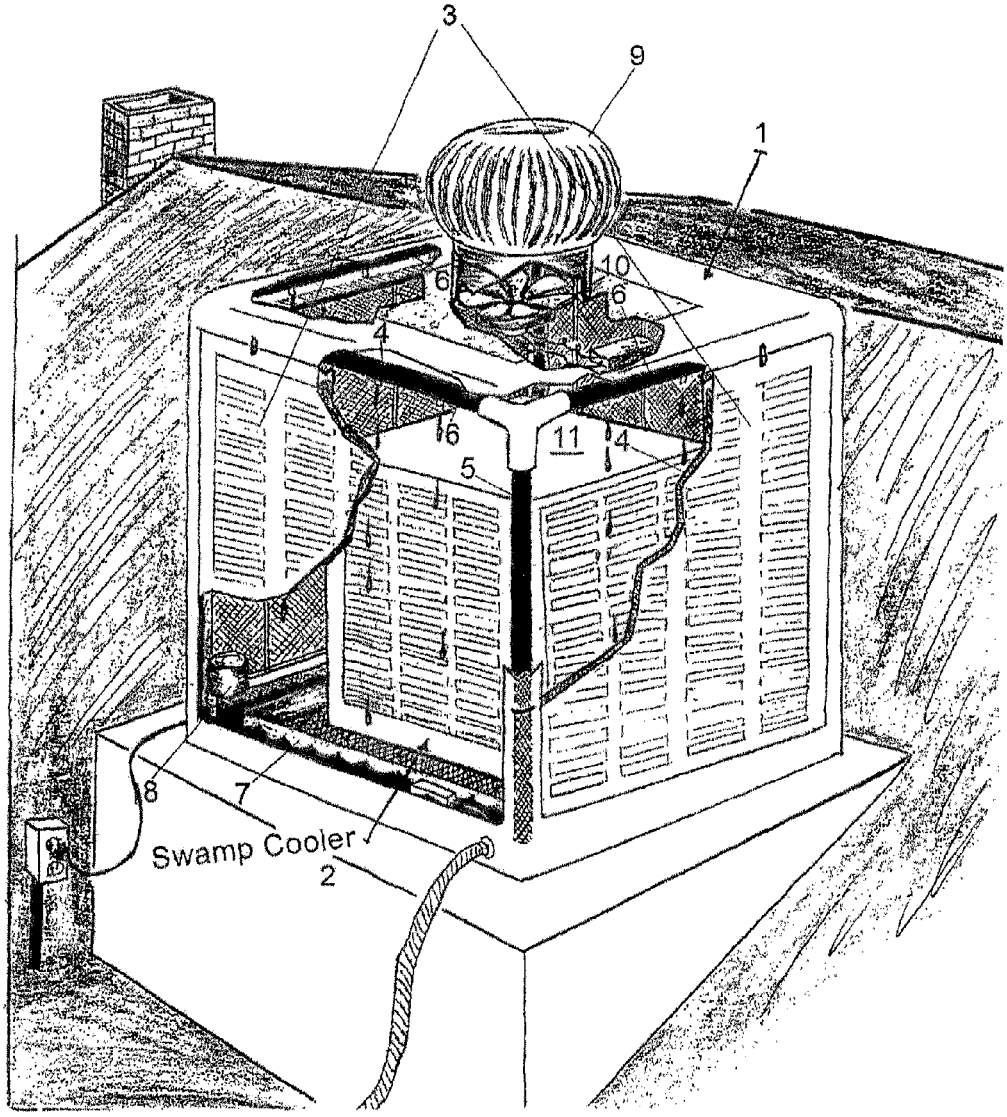
FIG. 2 is a cutaway illustration of a multi-stage evaporative cooling system in accordance with the present disclosure.

In FIGS. 1-3 the outer cooler 1 is shown in a box configuration, because most pre-existing coolers that it will be built to surround are similarly in box configurations, but other configurations are also possible and are intended to be covered by the present disclosure. In addition to providing multiple stages of direct evaporative cooling, the outer cooler shades the pre-existing cooler to reduce losses due to radiated heat from the sun. For this purpose, the materials of the outer cooling unit may be chosen to provide insulative properties.

Each side of the outer cooler contains a removable panel 3 including a cooling pad 4. Alternatively, not all sides will include removable panels. The cooling pads 4 are moistened during operation to expose the air passing through the cooling pads, similar to the operation of the pre-existing cooler. The frame of the outer cooler 1 preferably is comprised of water pipes 5, 6. This is done to simplify construction, but is not mandatory for the function of the system. Alternatively, the water pipes may be supported by conventional frame members. The top horizontal water pipes 6, include drip nozzles for allowing the water to flow through the cooling pads. Below each panel is a trough 7 for collecting water that did not evaporate while within the cooling pads 4. This water may then be recycled using water pump 8. The bottom of the outer cooler 1 is fixed to the roof or other structure with a roofing sealant or other adhesive known in the art, or with a gasket and mechanical fasteners.

At the top of the outer cooler is an exhaust 9 with a fan 10. The fan effectively operates to reduce the pressure of the air in the vapor space 11 between the outer cooler 1 and the pre-existing cooler 2. As the pressure in the vapor space drops, the wet-bulb temperature also drops, allowing the air to absorb additional moisture when passing through the pre-existing cooler 2, thus increasing the efficiency of the system relative to the ambient wet-bulb temperature. A second fan may also be included. Further, the system may employ desiccant or another dehumidification method to remove the moisture from the vapor space.

The outer cooler may be operated as an appendage of the pre-existing cooler, operating from the same control signals received by the pre-existing cooler. The outer cooler may share the same water source and water pump. Other alternatives are also possible. For example, the pre-existing cooler may be used without the outer cooler, wherein the outer cooler functions to block solar radiation and increase efficiency of the pre-existing cooler. The cooling pads of the outer cooler may also function as air filters, reducing the amount of dust and allergens transported into the building.

Figure 4:
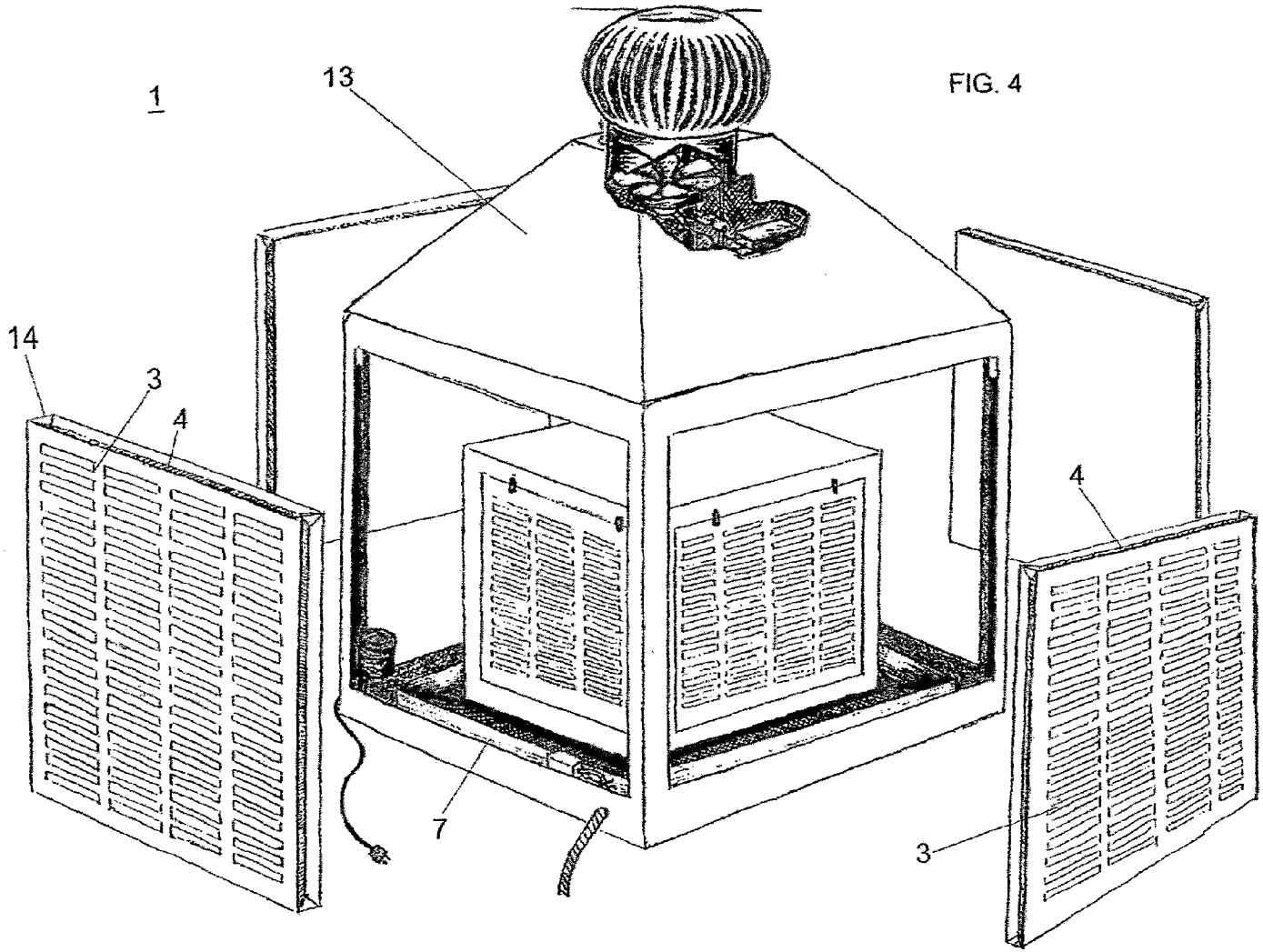
FIG. 4 is an illustration of a multi-stage evaporative cooling system in accordance with the present disclosure, having a sloped roof.

An alternative design, shown in FIG. 4, shows an outer cooler 1, wherein the top of the shell 13 is formed with a slope. By sloping the top of the shell, the exhaust fan increases the tendency to expel the warmest available air within the vapor space 11. In addition, the sloped top allows the vapor space to expel smoke or other elements efficiently, even when the exhaust fan is not running.

Figure 5:
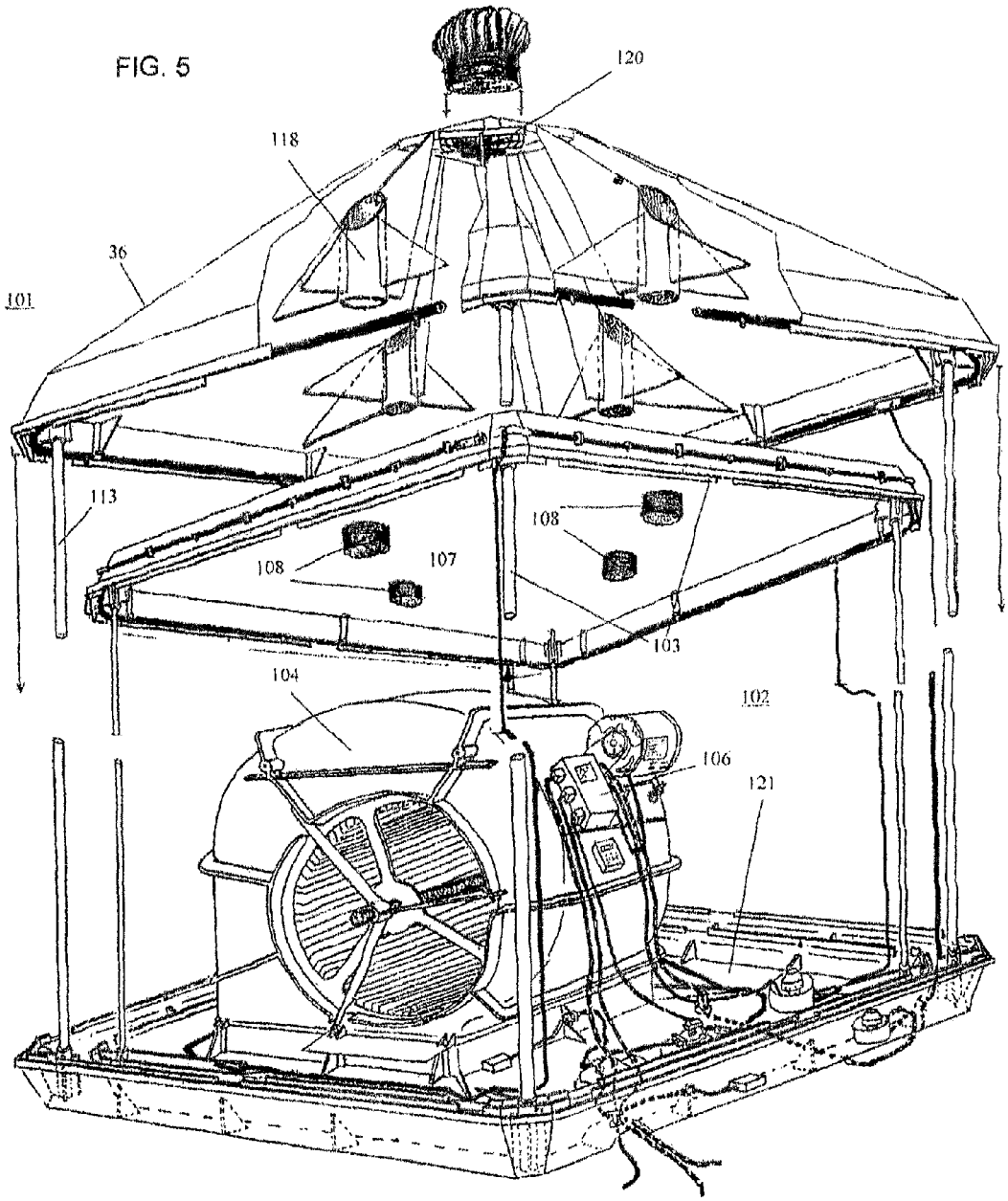
FIG. 5 is an exploded view of a multi-stage evaporative cooling system in accordance with another aspect of the present disclosure.

Another aspect of the present disclosure provides an evaporative cooling system that is constructed as a single unit, rather than an outer cooler matched to a pre-existing cooler. Referring to FIG. 5, the evaporative cooling system of this aspect of the disclosure comprises an outer cooling unit 101 and an inner cooling unit 102. The inner cooling system is constructed to operate similar to a conventional evaporative cooling system. Here, the frame of the inner cooling unit preferably is constructed using piping 103 for carrying water to inner cooling pads (not shown). Alternatively, the piping could be supported by conventional framing elements. A plurality of water nozzles 105 deliver the water to the top of the cooling pads. Within the frame of the inner cooling unit is a blower 104 for directing air through the cooling units into the enclosed area or building.

A control unit 106 is also included in the system and is shown here attached to the blower but may be located elsewhere within the system. The control unit receives a signal from within the enclosed area or building and activates the blower and water pump as desired in the case of a conventional evaporative or so-called "swamp cooler".

The top 107 of the inner cooling unit includes a plurality of guides 108 for providing support to the top 117 of the outer cooling unit 101. The outer cooling unit is constructed similar to the inner cooling unit with water pipes 113 and nozzles 115. Both the inner cooling and the outer cooling units further include troughs for collecting water that did not evaporate while gravity fed through the cooling pads. The top of the outer cooling unit includes support elements 118 that interface with the guides 108 of the inner cooling unit. Finally, the evaporative cooling system of this aspect of the present disclosure also includes at least one exhaust fan 120 for aiding in the cooling process.

The present aspect of the disclosure may also include misting nozzles 116 in the vapor space to further saturate the air, driving the temperature to the wet bulb temperature. The spray mixes with the depressurized air while the exhaust fan is running and further cools the air within the vapor space prior to entering the inner cooling unit.

Another element of the disclosure is the inclusion of a monitor 121 for detecting smoke or other harmful chemicals, which could be present if, for example, a blower motor were to overheat or an external event occurred. Such a chemical monitor would be connected to the controls of the evaporative cooling system and may be used to shut off the blower and other elements so that the harmful chemicals were not passed into the building. This includes chemicals that may be escaping from the building. Advantageous locations for the monitor include on the blower (as shown) or next to the exhaust fan.

Another improvement provided by the evaporative cooling system of the present disclosure is in the form of reducing alkali materials in the system water. This is accomplished by using an alkali reducing aluminum frame or mesh to hold the cooling pads in place. Other materials that are known to reduce impurities in water and air may also be used with the cooling pads to improve the air quality. The present disclosure also includes a float switch located in the trough to ensure that water does not enter the system if the trough is filled beyond a pre-determined level.

The present disclosure also provides an improved water float valve for an evaporative cooler. The improved water valve has been shown to minimize the temperature of the water in the reservoir of the evaporative cooler unit, thereby maximizing the potential cooling effect of the evaporative cooling process.

Figure 6A:
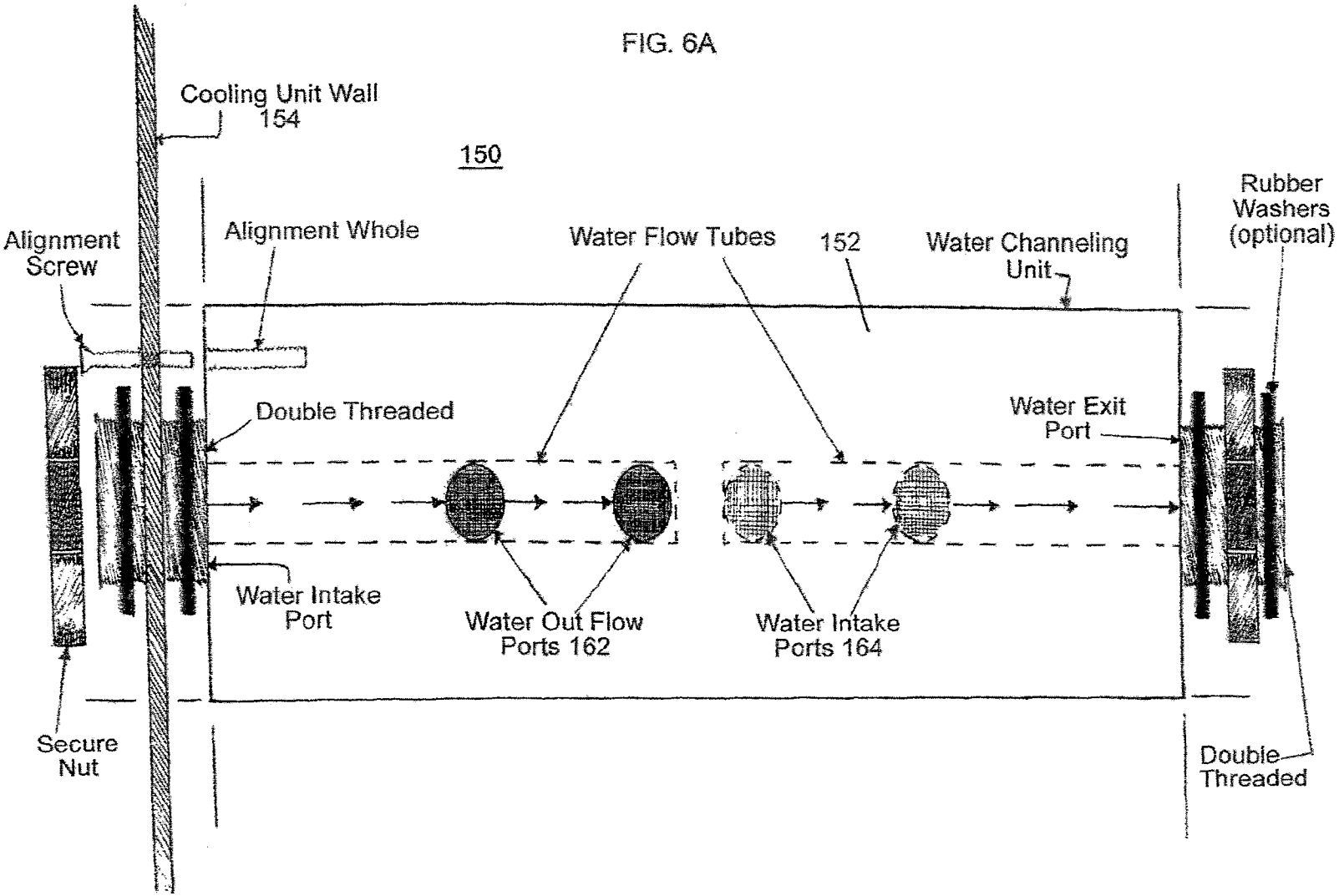
FIGS. 6A, 6B, and 6C are illustrations of an improved water float valve in accordance with the present disclosure.
Figure 6B:
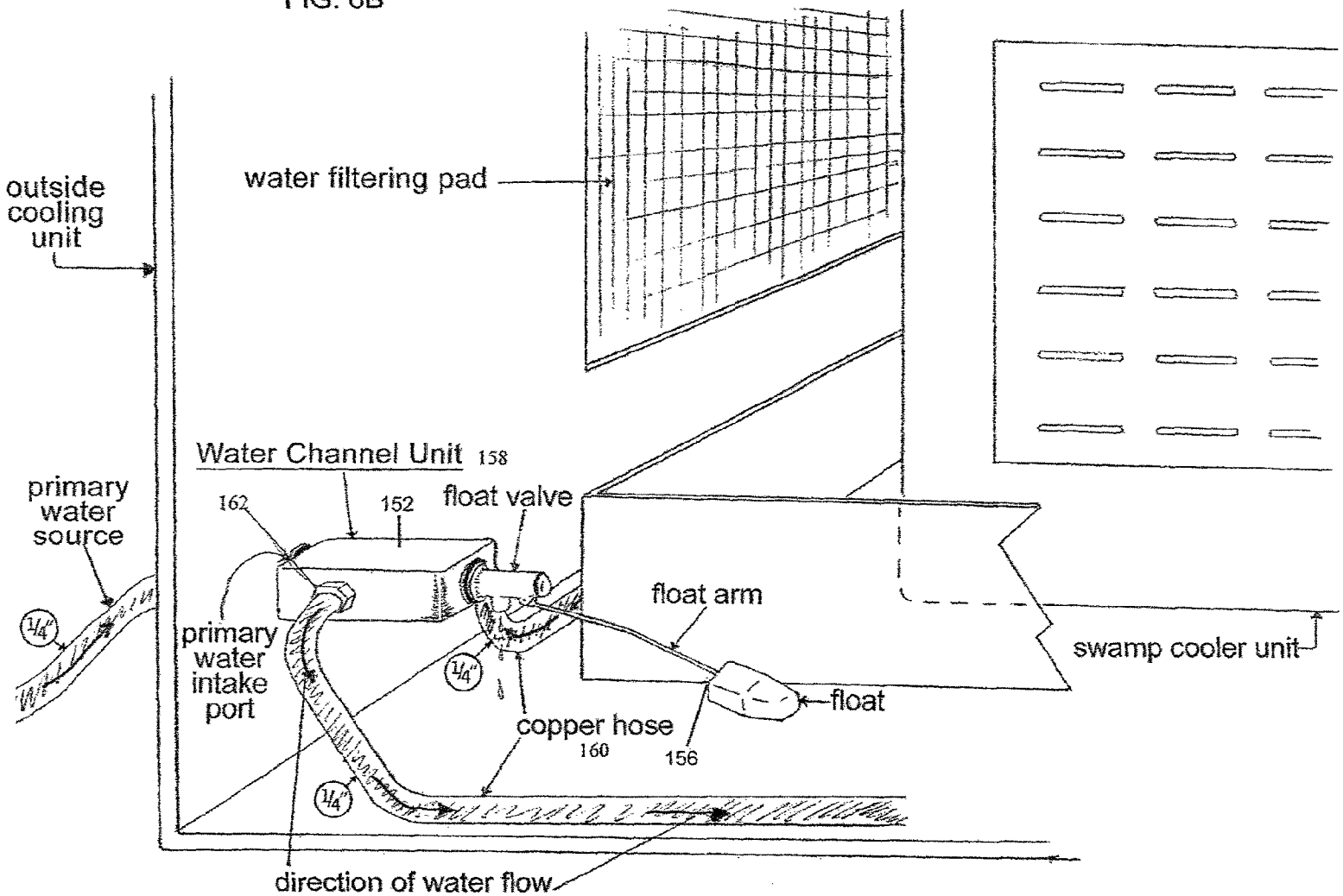
Figure 6C:
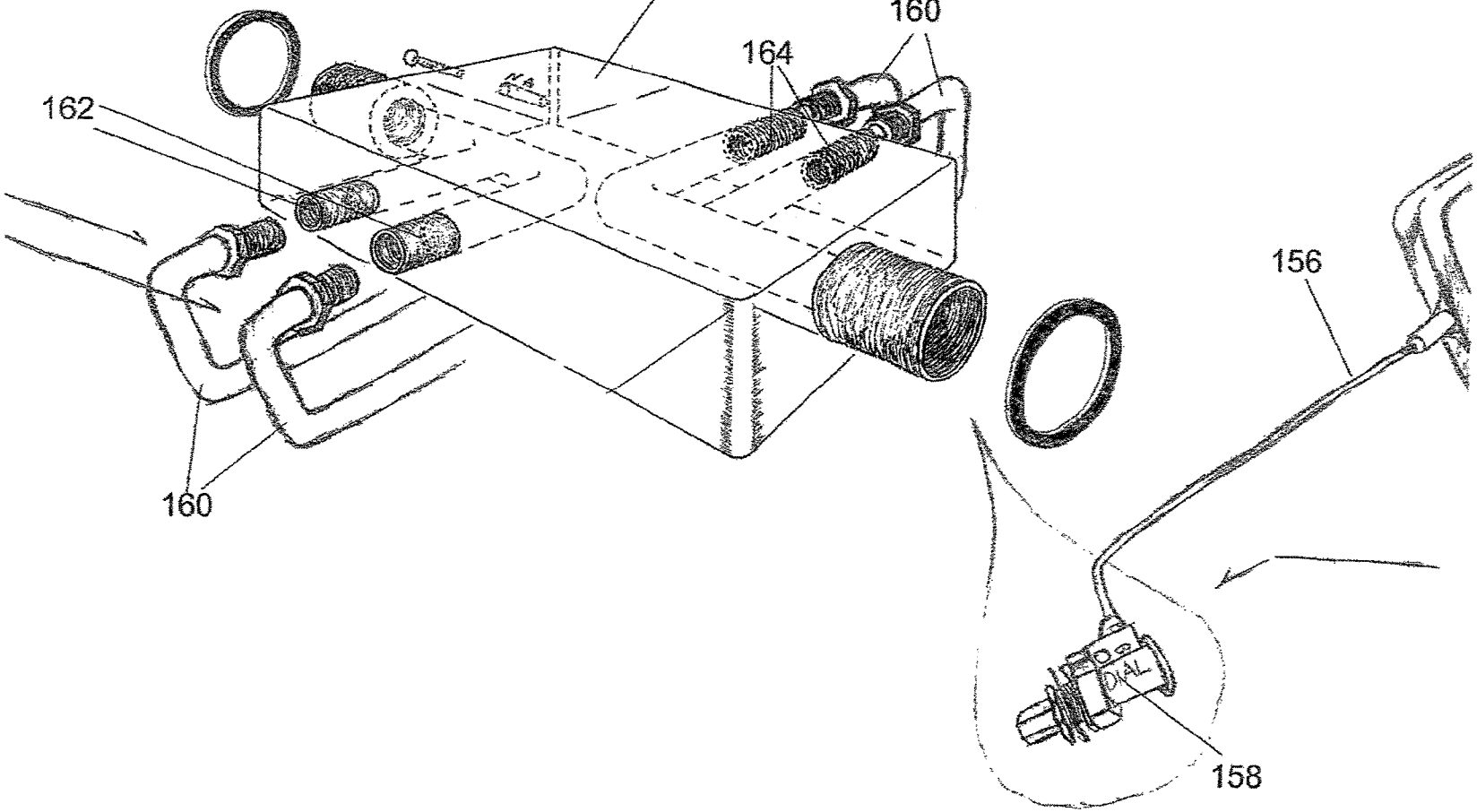

Referring to FIGS. 6A-C, the improved water float valve 150 of the present disclosure is comprised of a water channeling unit 152 that is connected through a wall 154 of the evaporative cooler to a water supply and also to a float switch 156 and water nozzle 158 for dispersing water into the reservoir. The water channeling unit first diverts water from the water supply into recirculation piping 160 through one or more recirculation outlets 162. The large majority of the length of recirculation piping 160 runs through the reservoir and is thus submerged in the water supply contained therein. The downstream end of the recirculation piping is connected to one or more recirculation inlets 164. The float switch 156 senses when the water level in the reservoir is below a predetermined level and controls the water nozzle 158 to allow additional water to enter the reservoir through the water channeling unit 152 and the recirculation piping 160.

Figure 7:
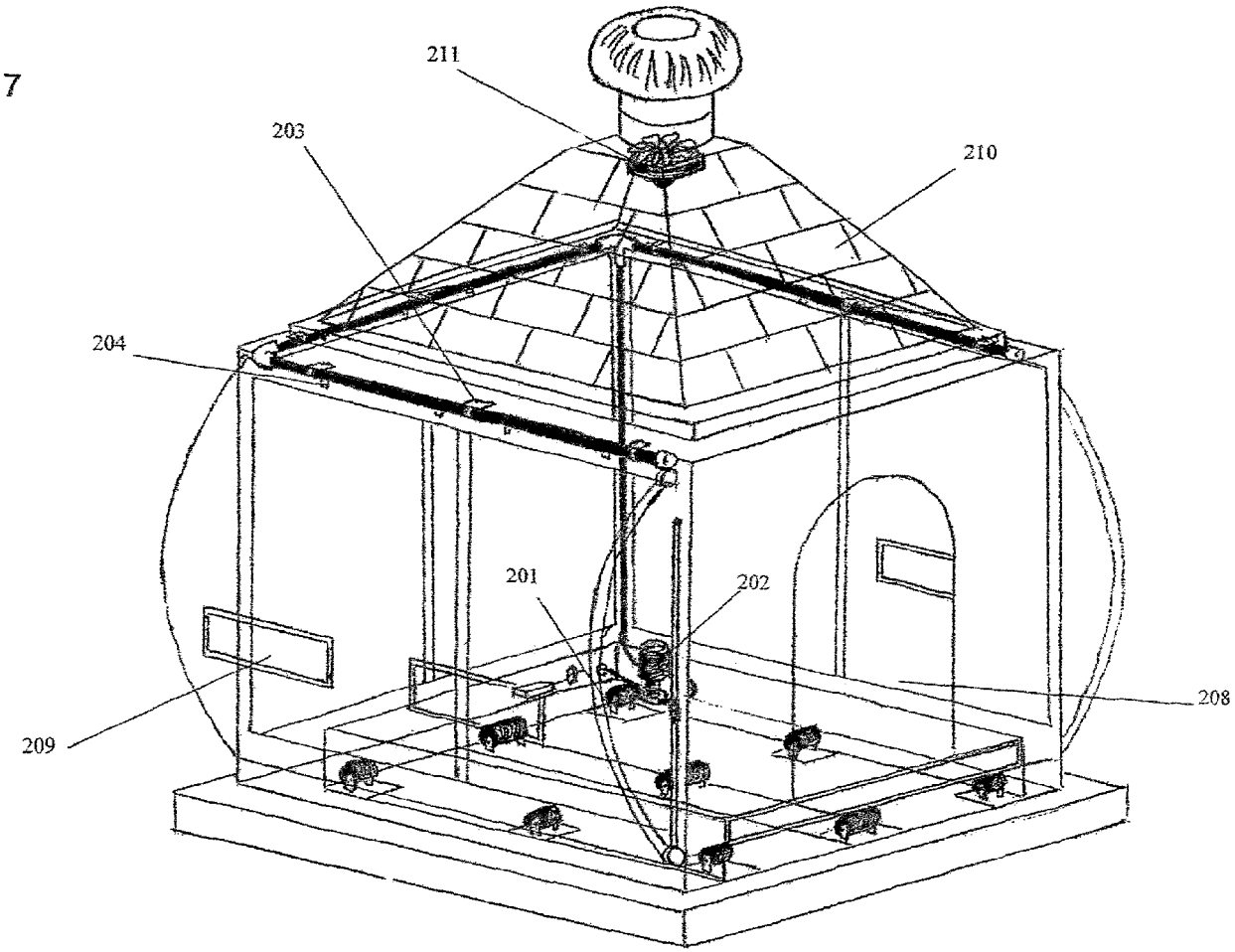
FIGS. 7 and 8 are illustrations of a pet shelter having an evaporative cooling system in accordance with the present disclosure.
Figure 8:
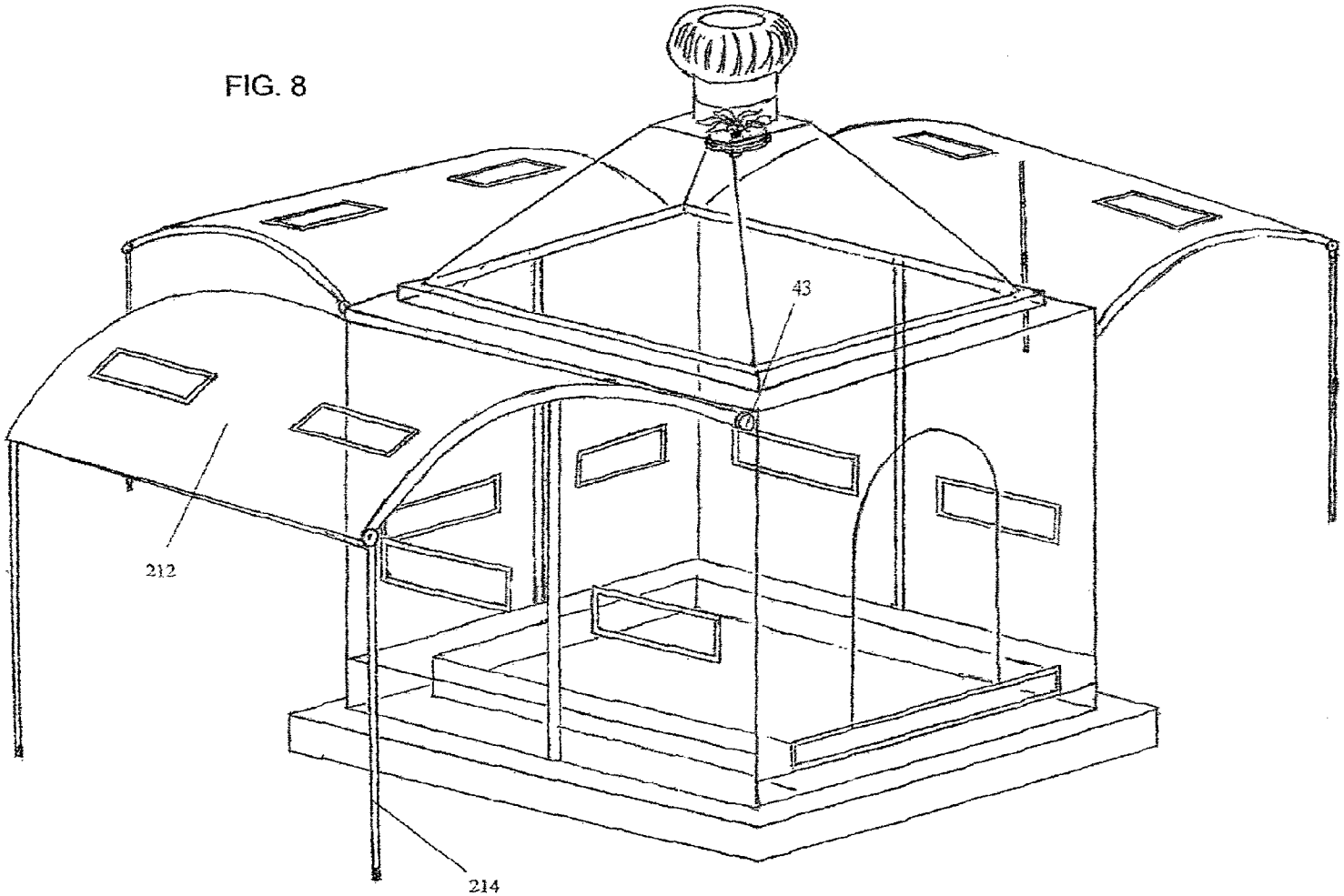

Another aspect of the present disclosure is the use of many of the elements described above in a pet shelter, such as a dog house or other animal pen that may be partially open to the atmosphere. Referring to FIGS. 7 and 8, pet shelter having a evaporative cooling system according to the present disclosure comprises a small structure for housing the pet, wherein the structure includes a water supply 201, a water pump 202, a water distribution system 203, a plurality of misting or drip nozzles 204, and a trough 205 at the bottom of each wall for collecting the water. The pet shelter may also include a sloped roof 210 and a fan 211 for evacuating the hot air collecting in the top of the pet shelter and also to produce a continuous airflow through the shelter. The pet shelter structure has a door 208 through which the animal may enter. One or more windows 209 may also be included in the structure. The trough 205 may include one or more float valves to make sure that the water supply does not exceed the capacity of the trough.

Because the evaporative cooling effect will require some continuous airflow, the walls may be constructed of a perforated material, such as for example peg board or a metal mesh, to increase the level of airflow. In addition, the curved side walls 212 may be connected to the roof by hinges 213 and can be opened and supported by stands 214, as shown in FIG. 8, to increase the airflow through the living space. The side walls 212 can be closed to isolate the pet from the elements on colder days.

The water supply for the pet shelter evaporative cooling system may also be used to provide continuous drinking water for the pet. If desired, the drinking water may be stored separately from the trough.

It should be emphasized that the above-described embodiments of the present system, particularly, and "preferred" embodiments, are merely possible examples of implementations and merely set forth for a clear understanding of the principles of the disclosure. Many different embodiments of the multi-stage evaporative cooling system described herein may be designed and/or fabricated without departing from the spirit and scope of the disclosure. All these and other such modifications and variations are intended to be included herein within the scope of this disclosure and protected by the following claims. Therefore the scope of the disclosure is not intended to be limited except as indicated in the appended claims.

The invention claimed is:

1. A pet shelter comprising:

a structure surrounding an interior space accessible by a pet; and a cooling system for cooling the interior space, wherein the cooling system comprises a water supply system connected to a water source, including a plurality of lengths of water piping and nozzles, and a trough for collecting water that does not evaporate; and an exhaust fan located in the top of the pet shelter, wherein at least one wall is hinged to a top of the pet shelter and may be propped open using a stand.

2. The shelter of claim 1, wherein at least one wall of the shelter is constructed of a material that allows some air to pass through.

3. The shelter of claim 1, wherein the shelter has a sloped roof.

4. A pet shelter comprising:

a structure surrounding an interior space accessible by a pet; and a cooling system for cooling the interior space, wherein the cooling system comprises a water supply system connected to a water source, including a plurality of lengths of water piping and nozzles, and a trough for collecting water that does not evaporate; and an exhaust fan located in the top of the pet shelter, wherein the cooling system comprises:

an outer cooling unit and an inner cooling unit, each unit including a shell and a plurality of removable panels, forming a vapor space in between the outer cooling unit and the inner cooling unit; and a water source;

wherein the outer cooling unit further comprises at least one exhaust fan located in the top of the outer cooling unit and wherein at least some of the removable panels of each unit comprise cooling pads.

5. The shelter of claim 4, wherein the outer cooling unit completely encloses the inner cooling unit.

6. The shelter of claim 4, wherein the inner cooling unit is a pre-existing evaporative cooling system.

7. The shelter of claim 4, wherein the outer cooling unit has a sloped roof.

8. The shelter of claim 4, further comprising a plurality of misting nozzles located in the vapor space.

9. The shelter of claim 4, further comprising a chemical monitoring device.

10. The shelter of claim 4, further comprising a water supply system connected to the water source, including a water pump, a plurality of lengths of water piping and nozzles for supplying water to the cooling pads, and a trough for collecting water at the bottom of the cooling pads.

11. The shelter of claim 10, wherein the water supply system further comprises a water float switch.

12. The shelter of claim 11, wherein the water float switch is connected to a water channeling unit and a length of recirculation piping.

13. The shelter of claim 12, wherein the water piping comprises the frame of the outer cooling unit.

14. A method for cooling a pet shelter by evaporative cooling, comprising:

directing air through a first evaporative cooling unit into a vapor space;

partially evacuating the vapor space using at least one exhaust fan;

passing the air through a second evaporative cooling unit; and delivering the air to the pet shelter.

15. The method of claim 14, wherein the first evaporative cooling unit and the second evaporative cooling unit operate by direct evaporative cooling.

16. The method of claim 14, further comprising releasing water into the vapor space through a plurality of misting nozzles.

17. A pet shelter comprising:

a structure surrounding an interior space accessible by a pet; and a cooling system for cooling the interior space, wherein the cooling system comprises a water supply system connected to a water source, including a plurality of lengths of water piping and nozzles, and a trough for collecting water that does not evaporate; and an exhaust fan located in the top of the pet shelter, wherein the cooling system comprises:

an outer cooling unit and an inner cooling unit, each unit including a shell and a plurality of removable panels, forming a vapor space in between the outer cooling unit and the inner cooling unit;

a water source; and a chemical monitoring device;

wherein the outer cooling unit further comprises at least one exhaust fan located in the top of the outer cooling unit.

18. A pet shelter comprising:

a structure surrounding an interior space accessible by a pet; and a cooling system for cooling the interior space, wherein the cooling system comprises a water supply system connected to a water source, including a plurality of lengths of water piping and nozzles, and a trough for collecting water that does not evaporate; and an exhaust fan located in the top of the pet shelter, wherein the cooling system comprises:

an outer cooling unit and an inner cooling unit, each unit including a shell and a plurality of removable panels, forming a vapor space in between the outer cooling unit and the inner cooling unit;

a water source; and a water supply system connected to the water source, including a water pump, a plurality of lengths of water piping and nozzles for supplying water to the cooling pads, and a trough for collecting water at the bottom of the cooling pads, and wherein the water supply system further comprises a water float switch, connected to a water channeling unit and a length of recirculation piping;

wherein the outer cooling unit further comprises at least one exhaust fan located in the top of the outer cooling unit.

19. The shelter of claim 18, wherein the water piping comprises the frame of the outer cooling unit.

* * * * *